United States Patent [19]

Elliott, Jr.

[11] 4,451,044

[45] * May 29, 1984

[54] GOLF TRAINING AID

[76] Inventor: Denvier D. Elliott, Jr., 4512 Galaxy Ave., Las Vegas, Nev. 89102

[ * ] Notice: The portion of the term of this patent subsequent to Dec. 30, 1997 has been disclaimed.

[21] Appl. No.: 308,415

[22] Filed: Oct. 5, 1981

[51] Int. Cl.[3] ..... A63B 69/36

[52] U.S. Cl. ..... 273/189 A; 128/87 R

[58] Field of Search ..... 273/189 A, 54 B; 128/87 R, 88, 90, 77

[56] References Cited

U.S. PATENT DOCUMENTS

| | | | |
|---|---|---|---|
| D. 234,434 | 3/1975 | Trevino | 273/189 A X |
| 802,623 | 10/1905 | Camp | 273/189 A |
| 2,794,638 | 6/1957 | Risher et al. | 273/189 A X |
| 2,924,458 | 2/1960 | Barry | 273/189 A X |
| 2,947,307 | 8/1960 | Hoppe | 128/90 |
| 3,048,169 | 8/1962 | Pierce | 128/90 |
| 3,217,332 | 11/1965 | Gross | 128/77 X |
| 3,339,926 | 9/1967 | Coupar | 273/189 A X |
| 3,423,095 | 1/1969 | Cox | 273/189 A |
| 3,700,245 | 10/1972 | Nannini | 273/189 A |
| 3,906,943 | 9/1975 | Arluck | 128/87 R X |
| 3,990,709 | 11/1976 | DeRogatis | 273/189 A |
| 4,241,922 | 12/1980 | Elliott | 273/189 A |

*Primary Examiner*—George J. Marlo

*Attorney, Agent, or Firm*—Seiler, Quirk & Tratos

[57] ABSTRACT

A training aid for developing muscle memory in a golfer's leading hand for improving the ability to make chip and pitch shots has a hand-restricting wall which overlies the back of the golfer's hand and wrist. The wall has a lenthwise hinge which permits proper fitting. A pair of straps extending around the hand and wrist maintain the device in place.

6 Claims, 6 Drawing Figures

GOLF TRAINING AID

BACKGROUND OF THE INVENTION

This invention relates to a training aid to assist a golfer in learning proper technique for chip and pitch shots. In particular, the invention discloses an improvement to the device disclosed in my U.S. Pat. No. 4,241,922, issued Dec. 30, 1980, and entitled Golf Training Aid.

One of the most difficult shots for a golfer to learn properly, and for a golf professional to teach, are pitch or chip shots executed within about 20 yards of the green. These shots are some of the most important in the game of golf, since a well-executed pitch shot will enable a golfer to get down in one putt, thereby ultimately making a very substantial difference in his score. Generally accepted teaching philosophy would indicate that these shots be executed with a short, smooth backswing, and with a firm wrist.

Because most golfers spend most of their practice time taking full swings with a variety of woods or irons, they are accustomed to taking relatively large backswings, and to braking the wrists just prior to the moment of impact of the club head with the ball. For chip shots and pitch shots, however, breaking of the wrists proximate to impact can result in imparting an undesired spin to the ball, topping or "skulling"t0 the ball, or striking the ground prior to the ball, all of which are detrimental to the accuracy of the shot. For an average golfer, poor chipping can easily add six to ten strokes per round of golf.

Because of the natural tendency for a golfer's wrists to break during any iron shot, teaching a contrary habit for very short shots can be quite difficult. In my prior U.S. Pat. No. 4,241,922, a golf training aid was disclosed which is worn on the lower arm and wrist and which prohibits undesired motion of the hand about a wrist axis. The purpose of the invention is to provide an aid for training of certain forearm, wrist, and hand muscles to facilitate the desired "muscle memory" for proper execution of pitch and chip shots. The device disclosed in the patent is a lightweight removable training aid which precludes improper hand and wrist action during the act of performing a pitch or chip shot.

As shown in my prior patent, the golf training aid is a device which attaches to the leading arm of a golfer (i.e., the left arm of a right-handed golfer) having a sleeve portion which encircles the forearm and wrist, and a hand-restricting portion which prevents substantial movement of the hand relative to the forearm in the forward and sideward directions. The sleeve and hand restricting portions are oriented to maintain the forearm and hand in a straight line during a chip or pitch shot. The device was held in place by a single Velcro strap which extended around the opening in the sleeve portion.

It has been found subsequently with additional testing of my device that the fit of the device to the golfer's hand is extremely important in achieving successful results. If the device is slightly too large for a golfer's hand, movement of the hand is not sufficiently restricted to provide consistent results; if the device is too small, it can be uncomfortable or even painful to the wearer. In addition, differences in shapes of people's hands can be substantial. Accordingly, to obtain optimum results, it is necessary to have a very large range of sizes and shapes of these training aids so that each golfer can essentially be custom fit for proper size.

In accordance with the present invention, the device shown in my prior patent is modified in certain respects to enable a single size of training aid to fit a range of hand sizes and shapes, and still provide a very comfortable but tight fit for each golfer. The most important features of the improved device include a hinge or seam along the entire forward wall portion of the device, and a second fastening strap which extends around the wearer's hand across its palm just under the first set of knuckles and maintains the wearer's hand in abutting relationship to the hand-restricting portion of the device. With the hinge or seam along the length of the training device, the device loses a portion of its lateral rigidity, and the fastening strap is essential to maintain the device in proper position on the back of the hand.

SUMMARY OF THE INVENTION

In a golf training device for attachment to a golfer's forearm and wrist which has a sleeve portion adapted to fit around the lower forearm and wrist, an attachment strap for retaining the sleeve portion in place, and a hand-restricting portion extending from the sleeve portion and fully overlying the back of the golfer's hand, said two portions generally comprising a rigid wall having its length extending from the golfer's lower forearm over the first set of knuckles on hand, the improvement which comprises hinge means extending the entire length of the device approximately centrally located in the rigid wall, and fastening means for binding the hand-restricting portion of the device to the back of the golfer's hand.

BRIEF DESCRIPTION OF THE DRAWINGS

The invention is best understood with reference to the drawings, in which.

DETAILED DESCRIPTION OF A PREFERRED EMBODIMENT

Figure 1:
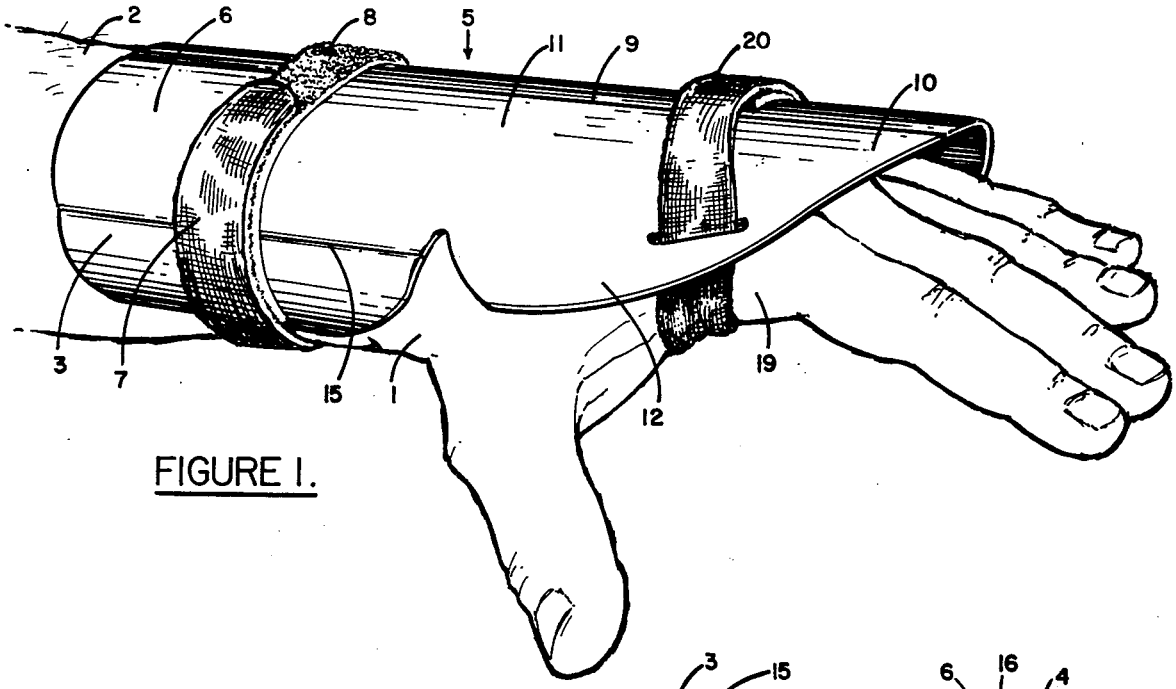
FIG. 1 is a perspective view of the golf training aid of the invention in place upon a golfer's left hand.

Referring to FIG. 1, the golf training aid of the invention is shown fastened in place upon the back of the golfer's left forearm and hand. The device shown is for use by a right handed golfer in which the leading arm of the golf swing is the left arm; for a left handed golfer, a mirror image of the device shown would be used.

Figure 2:
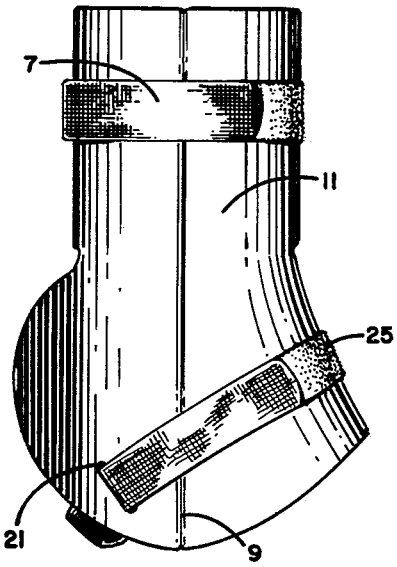
FIG. 2 is a front elevational view of the training device.
Figure 4:
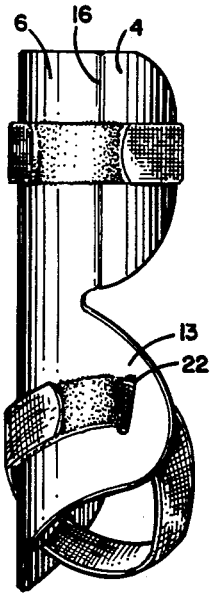
FIG. 4 is a side elevational view of the other side of the device.
Figure 5:
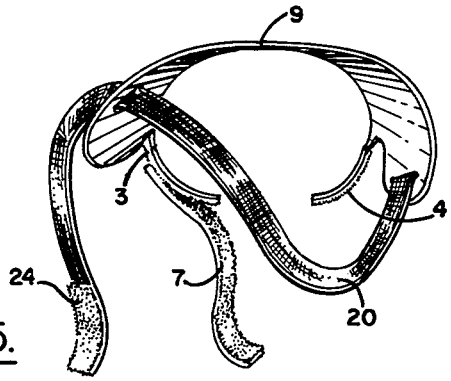
FIG. 5 is a bottom end view of the device.

The training aid 5 is fabricated from a lightweight, substantially rigid plastic material formed to generally fit the outer contours of the lower arm, wrist, and back of the hand. A substantially circular sleeve portion 6 of the device fits over the forearm and extends over the wrist as shown in FIG. 1. Two contoured flap sections 3 and 4 (see also FIGS. 3 and 4) are hinged along seams 15 and 16 enabling the sleeve portion to fit snugly around wrists of various sizes. A concave hand-restricting portion 10 extends over the back of the hands and over the first set of knuckles (metacarpal phalangeal joints) 19. The training aid has a forward wall surface 11 extending along the entire length of the training aid in a substantially straight line, as shown in FIGS. 1, 2, and 5. The straight forward wall surface of the training aid is extremely important in precluding forward motion of the hand relative to the wrist (i.e., breaking the wrists), which is by far the most common mistake made by golfers in executing a pitch or chip shot.

The device of the invention is attached to a golfer's leading wrist by means of the two hinged sections on the sleeve portion which permit insertion of the forearm into the sleeve, and which is snugly fastened to the forearm by means of a strap 7. The removable strap 7 attaches to a strip of material 8 which extends circumferentially around the sleeve portion 6 and the two hinged flaps 3 and 4. This material has fastening means which interengage with corresponding fastening means on the undersurface of strap 7. The preferred fastening means are conventional hook and loop type fasteners, marketed commercially under the trademark "VELCRO". Other conventional forms of attachment, such as a buckle or snaps, may also be used.

Figure 3:
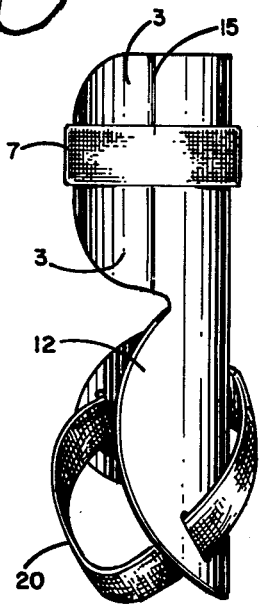
FIG. 3 is a side elevational view of one side of the device.

The training aid of the invention also includes a hand-restricting portion 10 which is concave and fits over the entire back of the golfer's forward hand to confine the hand against movement relative to the forearm in the direction of the swing. The device preferably extends entirely over the golfer's first set of knuckles, as shown in FIG. 1. The substantially flat forward wall 11 terminates laterally in a first sidewall 12 and a second sidewall 13 as best seen in FIGS. 3, 4, and 5. The hand restricting portion 10 is configured to overlie the back of the golfer's forward hand with sidewalls 12 and 13 curving about second and fifth metacarpal bones, respectively, in a manner which restricts substantial movement of the hand but avoids conflict with normal gripping of the club. Accordingly, while the golfer's leading hand is free to move about the wrist rearwardly of the direction of the swing, it is precluded from substantial movement in a direction perpendicular or transverse to the direction of swing and is also restrained from any motion about the wrist in the direction of swing further than a line defined by a straight line along the leading portion of the forearm of the golfer. In other words, during the chipping stroke, the training aid maintains the back of the forearm and the back of the hand substantially in a straight line. The device of the invention is not useful for, and in fact cannot be used for, a full golf swing, because the hand-restricting portion prevents normal cocking of the wrist necessary on the back swing.

In accordance with the invention, it has been found that the placement of a hinge approximately centrally located on a forward wall portion of the device greatly enhances the ability of the device to comfortably and closely fit a number of different sizes of hands and arms. The hinge 9 extends the entire length of the device from the forearm past the knuckles, and effectively separates the devices into two approximately equal-sized longitudinal sections. While the central hinge gives the training aid circumferential flexibility around the arm, existence of the hinge does not impair the ability of the device to prohibit cocking of the wrist. Existence of the hinge does, however, require the use of attachment means for binding the hand-restricting portion of the device to the back of the golfer's hand. In principle, any means for biasing the device toward the back of the hand would be acceptable; however, a particularly satisfactory means for accomplishing this result is the use of a second strap fastenter 20 as shown in FIGS. 1 through 5. The strap is a strong, slightly elastic member which extends through two slots 21 and 22 in the sides of the hand-restricting portion of the device. The strap, which extends across an upper portion of the palm of the golfer's hand, is fastened by Velcro fastening members 24 and 25, which provide an adjustable fit of the strap to the golfer's hand. When the strap is in place as shown in FIG. 1, the back of the hand is bound snugly to the inner surface of the hand-restricting portion of the training aid, thereby assuring that the golfer's forearm and hand maintain a straight line relationship during the chipping motion. As is best seen from FIG. 2, the strap for the hand-restricting portion is offset at an angle of about 30° to the sleeve strap; this orientation is simply to permit the hand-restricting strap to cross the golfer's palm at a location where it is most comfortable and least restrictive to holding the club.

Figure 6:
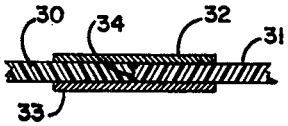
FIG. 6 is a partial section view of one method of constructing the hinge portions of the device.

The seams or hinges in the device of the invention may be constructed in a variety of manners. As shown in FIG. 2, the seam is constructed simply by molding a thin, flexible section between the two rigid longitudinal sections of the device. Another method of constructing the hinge is shown in FIG. 6. The hinge portion shown therein is fabricated by axially cutting a portion of the sleeve at 34, providing two rigid sections 30 and 31, and attaching thin, flexible strips of plastic 32 and 33 along the top and bottom of the cut, thereby permitting the rigid sections to pivot around the hinge. The plastic may be attached by any conventional adhesive. Construction of a hinge between rigid sections is conventional, and any known method may be used.

Certain variations may of course be effected in the device of the invention within the scope and spirit thereof, the essence of which is the provision of a firm and close fitting golf training aid having a hinged front wall and fastening means to bind the hand-restricting portion of the device to a golfer's hand. Accordingly, the invention should not be considered limited by the foregoing description of a detailed embodiment thereof but rather should be considered limited only by the following claims.

I claim:

1. In a golf training device for attachment to a golfer's forearm and wrist comprising a sleeve portion adapted to fit around the lower forearm and wrist, attachment means for retaining said sleeve portion in place and a hand restricting portion extending from the sleeve portion and fully overlying the back of the golfer's hand, said two portions generally comprising a rigid wall having its length extending from the golfer's lower forearm over first set of knuckles on the hand, the improvement therein which comprises a substantially straight hinge extending the entire length of the device approximately centrally located in said rigid wall and dividing said wall into first and second sections, means for connecting said first and second sections to said hinge, and fastening means for firmly holding the hand-restricting portion of the device immediately proximate to the back of the golfer's hand.

2. The golf training device of claim 1 wherein the fastening means comprises a flexible strap having an adjustable length adapted to extend across the entire palm of a golfer's hand and to attach to the device, thereby urging the back of the golfer's hand toward said device.

3. The device of claim 2 also comprising a pair of slots disposed in the hand-restricting portion of the device for receiving said strap, such that when the device is in place on a golfer's arm, the strap extends through each slot and entirely across the palm.

4. The device of claims 2 or 3 wherein the strap also comprises interengaging fastening means along end portions thereof.

5. The device of claim 4 wherein the interengaging fastening means are hook and loop compression fasteners.

6. The device of claim 1 wherein the sleeve portion has a pair of axially hinged flaps adapted to fold circumferentially around the golfer's wrist.

* * * * *